US008845460B1

(12) United States Patent
Feldstein

(10) Patent No.: US 8,845,460 B1
(45) Date of Patent: Sep. 30, 2014

(54) BASKETBALL RETURN SYSTEM

(71) Applicant: Jacob Feldstein, Princeton, NJ (US)

(72) Inventor: Jacob Feldstein, Princeton, NJ (US)

( * ) Notice: Subject to any disclaimer, the term of this patent is extended or adjusted under 35 U.S.C. 154(b) by 0 days.

(21) Appl. No.: 14/259,327

(22) Filed: Apr. 23, 2014

(51) Int. Cl.
*A63B 69/00* (2006.01)

(52) U.S. Cl.
CPC ..... *A63B 69/0071* (2013.01); *A63B 2243/0037* (2013.01); *A63B 2225/50* (2013.01)
USPC ..... 473/433; 473/447

(58) Field of Classification Search
USPC ..... 473/433, 570, 422, 458, 451, 457
See application file for complete search history.

(56) References Cited

U.S. PATENT DOCUMENTS 3,814,421 A * 6/1974 Spier, Jr. ..... 473/433
5,184,814 A * 2/1993 Manning ..... 473/433
6,469,628 B1 * 10/2002 Richards et al. ..... 340/573.3
6,702,292 B2 * 3/2004 Takowsky ..... 273/348
7,207,902 B1 * 4/2007 Hamlin ..... 473/353
7,927,237 B2 * 4/2011 Jenkins et al. ..... 473/433
8,253,586 B1 * 8/2012 Matak ..... 340/870.07
8,477,046 B2 * 7/2013 Alonso ..... 340/870.11
2006/0105857 A1 * 5/2006 Stark ..... 473/353
2009/0048039 A1 * 2/2009 Holthouse et al. ..... 473/415
2009/0048044 A1 * 2/2009 Oleson et al. ..... 473/570
2009/0191988 A1 * 7/2009 Klein ..... 473/480
2010/0113189 A1 * 5/2010 Blair ..... 473/433
2010/0261557 A1 * 10/2010 Joseph et al. ..... 473/433
2011/0118062 A1 * 5/2011 Krysiak et al. ..... 473/570

* cited by examiner

*Primary Examiner* — Gene Kim
*Assistant Examiner* — M Chambers
(74) *Attorney, Agent, or Firm* — Gottlieb, Rackman & Reisman PC

(57) ABSTRACT

The present invention is a system useful in returning a basketball to an individual by recognizing the individual's location relative to the basketball hoop. The system may further adjust its position to deliver the basketball to a person's location or the location to which the individual is moving by further recognizing the trajectory and pace of the individual, such as with the use of GPS devices.

16 Claims, 2 Drawing Sheets

BASKETBALL RETURN SYSTEM

FIELD OF THE INVENTION

This invention relates to a basketball return system. More specifically, the present invention is directed to an easy to install, lightweight basketball return system that rotates automatically by tracking a player's movement on a basketball court in order to return a basketball to a determined location upon a made basket.

BACKGROUND OF THE INVENTION

The present invention relates to a basketball return system and more particularly to a basketball return system that is easily mounted on a basketball hoop in order to send a basketball to a determined location.

Basketball is a sport where an individual tries to get the basketball through a basket. The individual may be known as a player or a shooter. There are also a number of terms to describe the equipment, playing court, and actions involved in the game. For example, the basket may be referred to as the hoop, net, rim, basket ring, goal, and other terms. The playing surface is often referred to as the court or the floor. These terms may be used interchangeably in relation to this invention.

To improve one's skills in basketball, practice is often required. Practice includes taking a number of shots at a basketball hoop. When a player shoots the ball, he or she must retrieve or rebound the ball from wherever it bounces to unless there is at least one additional player present to rebound the ball. The process of getting a rebound wastes valuable time that could be used by the player to practice shooting or other skills. It also precludes a player from developing a skill involving catching a ball and quickly shooting again from the spot at which or near which it is caught. The efficacy of the player's practice is therefore related to and determined by the efficiency with which the player can retrieve the basketball after making a shot and taking subsequent shots.

Devices exist for returning basketballs. Related basketball return devices suffer from several disadvantages. These devices are often large, difficult to transfer from one basketball hoop to another and are difficult to install. Further, many of these devices are only able to be positioned in one direction, resulting in a player having to run after the ball and wasting practice time. Therefore, the present invention fulfills an unmet need for the following reasons. The present invention includes a system which locates the current or future location of the player based on his or her movement to return the ball to an exact position. This concept of the basketball return system, which tracks a player's movement in order to send the basketball to a determined location, will allow a player to shoot more shots during a practice session, and allow a player to catch and shoot. The present invention automatically turns toward the present or future location of the player by recognizing and calculating an individual's trajectory and pace. Further, the present invention is easily installed onto a basketball hoop and is not cumbersome to move from one location to another.

SUMMARY OF THE INVENTION

The present invention is directed to a basketball return system that recognizes a player's location on the playing surface and delivers or passes the basketball to the player after it goes through the hoop. In order for the system to function, an assembly attaches to either an upper surface of a rim, a set of eyelets below and ordinarily attached to the rim, a net or a backboard using any known method such as but not limited to clamps to firmly secure the assembly under the basket.

Below the hoop and/or net, the system includes a delivery mechanism which is an apparatus that directs the downward traveling ball that has passed through the hoop. This apparatus is capable of rotating horizontally in a clockwise or counterclockwise direction as well as to adjust vertically in order for the ball to be delivered to a multitude of locations on the playing surface. This rotation is made possible by at least one of rings, gears, belts, bearings, wheels, slides, threaded components, or other mechanical devices.

The system has the ability to detect the location of the player on the court. This is accomplished by using at least one of radio frequencies, laser systems, GPS (global positioning system), indoor positioning systems, pressure sensors within or under the playing surface, as well as satellite and/or navigation or other methods. The system includes a processing component that can recognize the individual's location relative to the basketball hoop. Further, the processing component includes the ability to adjust the chute's position to deliver the basketball to that determined location and/or the determined location to which the individual is moving towards by further recognizing the trajectory and pace of the individual, as well as incorporating the amount of time it will take for the ball to reach the players. Some or all of the assembly rotates around an axis consistent with that of the hoop.

The system incorporates the amount of time by recognizing the ball's speed and rotation. The system further includes one or more sensors to sense the ball's speed and/or rotation. The system further includes a processor for processing data regarding the ball's movement and the target location, thereby directing a motor to adjust the chute clockwise or counterclockwise. Further, a transmitter may be worn by a player and/or placed on the surface of a basketball to enable the processor to calculate the appropriate direction and speed of the release of the ball from the assembly.

In the preferred embodiment, a single system may include the processor, memory and any sensors. The single system may be mountable under or near a rim, and may further include the assembly for returning the basketball (such as the chute and hooks).

DESCRIPTION OF RELATED ART

U.S. Pat. No. 7,008,337 to Kershaw ("Kershaw") discloses a device, which attaches to the rim and when the basketball goes through the hoop, it rolls down the device and back to the location of where the device is directed towards. The problem with this device is that it does not rotate so the ball is only returned to one spot and it cannot turn.

Another reference is U.S. Pat. No. 5,141,224 to Nolde ("Nolde"), which discloses a basketball return device that has a platform under the basket. The ball bounces off of the platform and back in the direction that the platform is pointed. The problem with this device is that it must be manually rotated.

Another basketball return device is U.S. Pat. No. 4,714,248 to Koss ("Koss"), which discloses a device consisting of two rotating heads that propel the basketball back at the player. It uses an ultrasonic detecting mechanism that finds where the player is and how far the player is from the device. It attaches to the rim of the basket and it goes under the basket. The shortcoming of this invention is that it is very large, costly, and hard to handle. The rotating heads are likely considered a safety hazard.

Another basketball return device is U.S. Pat. No. 4,869,502 to Wares ("Wares") discloses a return apparatus that attaches to the rim of the basket. It is lightweight and portable. It is made up of two long tubes that attach to the basket and the basketball rides on the tubes back to the player. It must be moved around the hoop to the direction the player wants it to go manually, which is one of its shortcomings. An additional shortcoming is that it does not allow the player to move far away from the return device because the player would not be able to get the ball.

Another related device is U.S. Pat. No. 5,776,018 to Simpson ("Simpson"), which discloses a basketball-passing device that has a net that must be installed adjacent to the backboard. The net collects made shots as well as closely missed shots and passes the ball back to a position on the playing surface. The device must be preprogrammed to a single position where the ball is to be delivered. The problem with this device is that the player cannot move around the court because the ball is passed back to one specific place. Another problem is that it requires electricity which may not be available where one is playing. Also, when this device is in use, an electrical cord is a safety hazard for those playing nearby.

Another related invention is U.S. Pat. No. 6,241,628 to Jenkins ("Jenkins"), which discloses a basketball return device that collects shots that pass through the hoop and returns the ball to a set location on the court. The location on the court for where the basketball is projected to can be preprogrammed to a set location. The basketball's passing elevation, velocity, and trajectory can also be changed. However, the device is too large and uses an excessive amount of space, which removes the use of important areas on the court.

Another related invention is U.S. Pat. No. 7,841,957 to Wares ("Wares"), which discloses a basketball return device that receives a basketball from the hoop and sends them down a runway towards the player. The runway can be turned manually. The basketball travels along the runway to a desired location on the playing surface. The problem with this is that it is very bulky and a player has to manually turn the runway in order for the ball to come right back to him or her.

However, none of the references discloses or suggests a device or system which automatically returns a ball to a determined location of the shooter or another player.

DETAILED DESCRIPTION OF THE INVENTION

Figure 1:
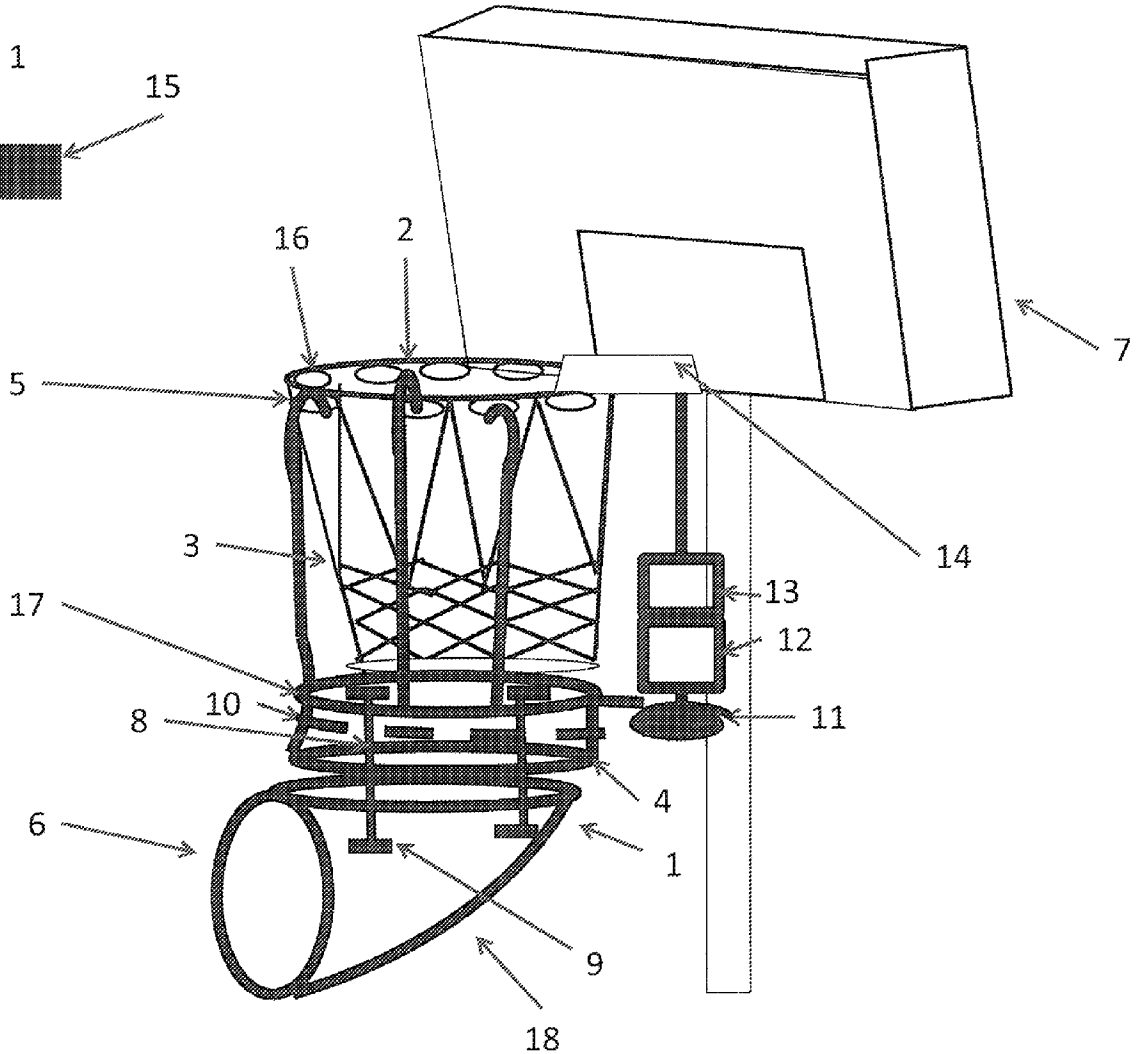
FIG. 1 is a view of an embodiment of a basketball return system hooked on a basketball hoop with a chute placed below the hoop.

FIG. 1 is a view of an embodiment of a basketball return assembly 1 mounted on a basketball hoop 2 with the use of a bracket 14. In the preferred embodiment, the system is an assembly of multiple elements. The bracket 14 connects the basketball hoop 2 to the backboard 7. The basketball return assembly 1 is connected to the hoop 2 by a set of hooks 5. In the preferred embodiment, the set of hooks 5 hang from the hoop 2 in the orientation from the outer diameter of the hoop 2 over the top of the hoop 2 circumference to the inner diameter of the hoop 2. The hooks 5 are also attached to the hoop V-belt pulley 4 at the lower end of the net 3, for example. Although a V-belt pulley system is shown, other known systems may be used, which serve the same function. The hooks 5 may also hang from a number of eyelets 16, which are molded on the hoop 2.

The hoop V-belt pulley 4 has a diameter of the same size or larger than the diameter of the hoop 2. Below the hoop V-belt pulley 4 is a chute 6. The chute 6 is connected to the hoop V-belt pulley 4 by bolts 8 and mating nuts 9, which secure the chute 6 to the V-belt pulley 4. The pulley 4 enables the chute 6 to rotate clockwise and counterclockwise.

The hoop V-belt pulley 4 is rotated by a V-belt 10. The V-belt 10 fits into a mating V-shaped groove on the outer circumference of the hoop V-belt pulley 4 as well as a mating V-shaped groove on the drive V-belt pulley 11. The drive V-belt pulley 11 is attached to the motor 12 which rotates the drive V-belt pulley 11. The V-belt 10 and the hoop V-belt pulley 4 rotate instantaneously with the drive V-belt pulley 11.

The system may include one or more sensors to sense the speed and/or rotation of the ball during its flight through the basket. The system further includes an embedded processor and a motor 12. The motor 12 is directed by the processor.

In the preferred embodiment of the present invention, a GPS transmitter receiver arrangement is used, although other positional transmitter/receiver arrangements may be used, such as other known point-to-point determinative approaches. The rotation of the motor 12 is determined by an output signal from a GPS receiver 13. The GPS receiver 13 receives a signal from a GPS transmitter 15. A GPS transmitter 15 is attached, worn or held by a player or placed on an outer surface of a basketball. The transmitter is in communication with a GPS receiver 13 and the combination allows the receiver to recognize the location of the individual player or basketball on a basketball court. The signal transmitted to the GPS receiver 13 will result in the rotatable elements of the basketball return assembly 1 to rotate toward the location or anticipated location of a player on the basketball court. Further, the GPS receiver 13 through the receipt of transmissions from the GPS transmitter 15, has the capability of identifying the motion of a player and causing the basketball return assembly 1 to rotate and deliver a ball passing through the hoop 2 to the location on the playing surface to which a player is moving.

Figure 2:
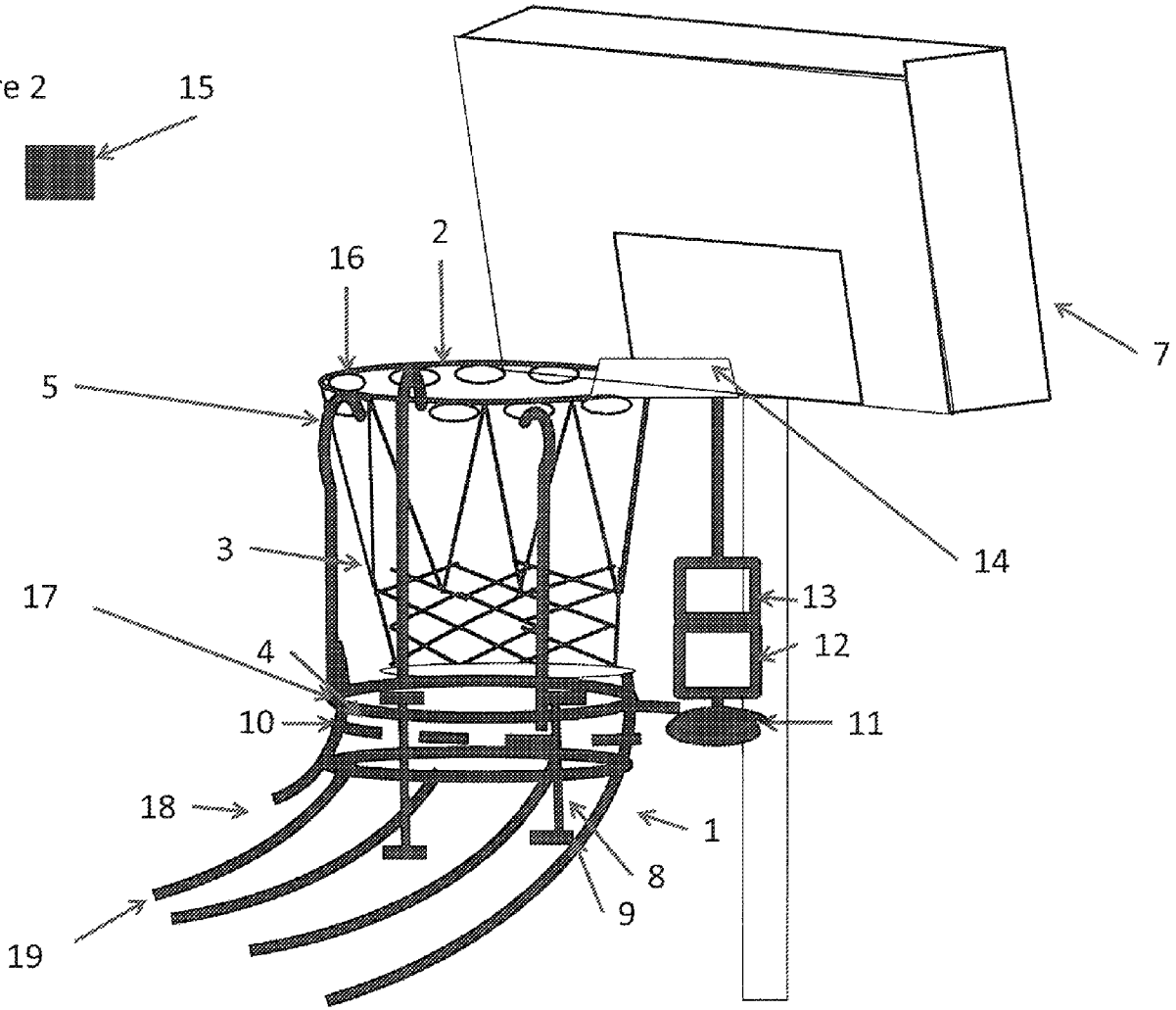
FIG. 2 is a view of a second embodiment of a basketball return system where a set of hooks is placed below a basketball rim with a set of rails placed below a net.

In the preferred embodiment of the invention, the basketball return assembly 1 is attached at the hoop 2 using multiple hooks 5. The hooks 5 will hold the assembly 1 surrounding net 3 preferably using the eyelets 16. The hooks 5 are removable at any time. The portion of the assembly 1 that is held to the hoop 2 is a hoop connection apparatus 17 inclusive of the portion attaching to hooks 5. A next portion of the system will be a delivery apparatus 18. The delivery apparatus 18 consists of a chute 6, or, as shown in FIG. 2, a set of rails 19 that form a cylindrical shape through which the basketball can pass through. The delivery apparatus 18 is connected to the hoop connection apparatus 17 in order for the delivery apparatus 18 to rotate on an axis allowing for a ball to be delivered to a multitude of locations on the court. The rotation is accomplished by motor 12 moving chute 6 into the desired position and orientation. The delivery apparatus 18 will point in the direction of the player using a GPS transmitter 15 that a player may attach on a shoe, hat, bracelet, anklet, or any other location on a player's body, clothing, or accessories. A GPS receiver 13 is preferably positioned on the basketball return assembly 1, which has a processor, a memory, and a battery. The assembly 1 will be constructed of lightweight materials for ease of installation and for transporting. The assembly 1 can be used indoors or outdoors and can be constructed to be waterproof to withstand the elements associated with playing basketball outdoors. The energy required by the basketball return assembly 1 for player detection, information processing and rotation of the delivery apparatus 18 may be supplied by a battery, wiring, or other means.

A sensor may further be included in the system of the present invention. The sensor senses the location and movement of the ball as it is in flight toward and through the basket. This sensor may be a geolocator, such as a GPS-based device, which may also include, or be in communication with a device, which delivers sensed data to a receiver. The sensor may be placed on the basketball or on a stationary object like a backboard. The processor receives data from a plurality of sources, where said data are indicative of movement of the ball as well as the location and/or movement of the person. The processor implements one or more algorithms using said data so as to direct the motor to properly position and properly orient the chute 6. Such positioning and orientation may be based on the person's last known position or based on an algorithm to estimate the person's anticipated position so that the ball and person arrive simultaneously. In one embodiment, the ball can be directed to a specific spot at the person, such as above his or her head, or at the person's waist line.

FIG. 2 shows a second embodiment in which rails 19 replace chute 6.

The accompanying drawings illustrate embodiments of a basketball return system and respective constituent parts, however, other types and styles are possible, and the drawings are not intended to be limiting in that regard. Thus, although the description above and the accompanying drawings contain much specificity, the details provided should not be construed as limiting the scope of the embodiment but merely as providing illustrations of some of the presently preferred embodiment. The drawings and the description are not to be taken as restrictive on the scope of the embodiment and are understood as broad and general teachings in accordance with the present invention. While the present embodiment of the invention has been described using specific terms, such description is for present illustrative purposes only, and it is to be understood that modifications and variations to such embodiment, including but not limited to the substitutions of equivalent features, materials, or parts, and the reversal of various features thereof, may be practiced by those of ordinary skill in the art without departing from the spirit and scope of the invention.

The invention claimed is:

1. A system for delivering a basketball to a player at a calculated future location of said player following the basketball passing through a basketball basket comprising:

an apparatus attachable to said basketball basket, including a chute, a set of hooks for facilitating attachment of said chute to a basketball rim assembly, and a motor;

at least one sensor configured to sense speed and rotation of a basketball;

a first wireless transmitter in communication with a wireless receiver, said wireless transmitter configured to transmit data regarding a player's trajectory and pace; and a processor configured to receive and gather data from said wireless receiver and to calculate said player's future locations based on said gathered data; to receive sensed information from said at least one sensor and to calculate a preferred position and orientation of said chute so as to deliver said basketball to one of said future locations; and to instruct said motor to adjust the position and orientation of said chute to said preferred position and orientation so that said basketball and said player arrive at the same location at about the same time.

2. The system of claim 1, further comprising a second wireless transmitter located on an outer surface of a basketball and said second wireless transmitter is in communication with said wireless receiver and transmits geolocation data of said basketball to said wireless receiver.

3. The system of claim 2, wherein said geolocation data of said basketball are sent to said processor and with said geolocation data of said basketball, said processor determines ball rotation and movement and directs said motor so that said basketball is delivered to a calculated future location of said player.

4. The system of claim 2, wherein said second wireless transmitter is a transmitter with a GPS receptor.

5. The system of claim 1, further comprising at least one sensor to sense speed and rotation of said basketball.

6. The system of claim 5, wherein said sensor sends collected information to a processor, and with said collected information said processor determines said basketball's rotation and movement and directs said motor so that said basketball is delivered to a calculated future location of said player.

7. The system of claim 1, wherein said wireless receiver collects information indicative of said player's location from a transmitter equipped with a GPS receptor.

8. The system of claim 1, wherein said first wireless transmitter comprises a GPS receptor and is affixed to at least one of said player's body and said player's clothing.

9. The system of claim 1, wherein said processor directs said motor so as to rotate said chute clockwise or counterclockwise in order to release said basketball to a calculated future location of said player.

10. The system of claim 1, further comprising a drive V-belt pulley attached to said chute and to said motor to enable movement of said chute.

11. A device for delivering a basketball to a calculated future location of a player following a made basket comprising:

a plurality of hooks for attaching to the loops on a basketball basket, a motor, a wireless receiver, a basketball return element attached to said plurality of hooks and extending below said basketball basket, at least one sensor configured to sense speed and rotation of a basketball;

a wireless transmitter in communication with a wireless receiver, said wireless transmitter configured to transmit data regarding a player's trajectory and pace;

a processor configured to receive and gather data from said wireless receiver and to calculate said player's future locations based on said gathered data; to receive sensed information from said at least one sensor and to calculate a preferred position and orientation of said chute so as to deliver said basketball to one of said future locations;

wherein said processor directs said motor to adjust the position and orientation of said chute to said preferred position and orientation so that said basketball and said player arrive at the same location at about the same time.

12. The device of claim 11, where the basketball return element is a chute.

13. The device of claim 12, wherein said processor directs said motor so as to rotate said chute clockwise or counterclockwise in order to release said basketball to a calculated future location of said player.

14. The system of claim 12, further comprising a drive V-belt pulley attached to said chute and to said motor to enable movement of said chute.

15. The device of claim 11, where the basketball return element is a set of rails.

16. The device of claim 11, wherein said wireless receiver collects information indicative of said player's location from a transmitter equipped with a GPS receptor.

* * * * *